United States Patent [19]

Moss

[11] 4,422,262

[45] Dec. 27, 1983

[54] GAME CALL HAVING BLADES OF DIFFERING HEIGHT

[76] Inventor: Robert R. Moss, Rte. 2, Cole Camp, Mo. 65325

[21] Appl. No.: 364,441

[22] Filed: Apr. 1, 1982

[51] Int. Cl.[3] ..... A63H 5/00

[52] U.S. Cl. ..... 46/189

[58] Field of Search ..... 46/189, 191, 177

[56] References Cited

U.S. PATENT DOCUMENTS

| | | | |
|---|---|---|---|
| 2,720,054 | 10/1955 | Grazier | 46/189 |
| 3,129,527 | 4/1964 | Williams | 46/177 |
| 4,343,108 | 8/1982 | Lee | 46/189 |

*Primary Examiner*—F. Barry Shay

*Attorney, Agent, or Firm*—Polster, Polster and Lucchesi

[57] ABSTRACT

A game call of the pivoted striker and blade type has a plurality of blades, side by side but spaced from one another and extending generally in a common direction away from the pivot end of the striker, one of the blades being taller than another, immediately adjacent blade, both of the blades being angled from the vertical in the same direction and beveled in the same direction along their top edges. The striker has a convex undersurface and the blades are adapted to engage the undersurface of the striker sequentially as the striker is moved but to remain at least momentarily in concurrent sounding engagement. The blades are constructed to produce sounds of different pitches.

10 Claims, 9 Drawing Figures

GAME CALL HAVING BLADES OF DIFFERING HEIGHT

BACKGROUND OF THE INVENTION

Game calls of the pivoted striker and blade type are well known. They are conventionally made with blades set at two sides of an elongated base at angles from the vertical in opposite directions from one another, the top edges of the blades being beveled in opposite directions, to sound alternately as the striker is moved back and forth. It has been discovered that by arranging two blades, side by side but spaced from one another, at angles from the vertical in the same direction and with the top edges of both blades beveled in the same direction, and arranged so that the underside of the striker engages the blades sequentially but remains at least momentarily in concurrent sounding engagement, the effectiveness of the call is greatly increased.

One of the objects of this invention is to provide a game call of the striker and blade type that is more effective in calling game than such calls known heretofore.

Other objects will become apparent to those skilled in the art in the light of the following description and accompanying drawing.

SUMMARY OF THE INVENTION

In accordance with this invention, generally stated, a game call of the striker and blade type is provided in which a paddle with a convex undersurface is pivotally mounted at one end, and a plurality of blades, side by side, but spaced from one another and extending generally in a common direction away from the pivot end of the striker are mounted on a base. One of the blades is taller than another, immediately adjacent blade. Both of the blades are angled from the vertical in the same direction and beveled in the same direction along their top edges and are adapted to engage the convex undersurface of the striker sequentially as the striker is moved in one direction, but to remain at least momentarily in concurrent sounding engagement. The blades are constructed and arranged to produce sounds of different pitches, by being provided with upper edges of different thicknesses or stiffness or span or some combination thereof.

DESCRIPTION OF THE PREFERRED EMBODIMENT

Figure 1:
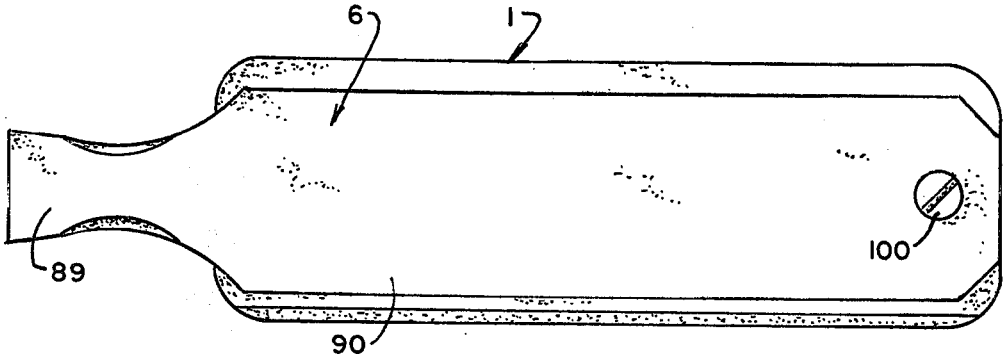
FIG. 1 is a top plan view of one embodiment of game call, in this case a turkey call, of this invention.

Referring now to the drawing for one illustrative embodiment of game call of this invention, reference numeral 1 indicates the complete call, in this case, a turkey call. The call 1 has a rectangular base 2 with rounded corners, which, in this illustrative embodiment, is shown as being wedge-shaped in end elevation. A first blade 3, second blade 4 and third blade 5 are mounted on the base. A striker or paddle 6 is pivotally mounted on a striker pivot pin 7 set in a wedge-shaped pivot block 8 at one end of the base. A complementary wedge block 9 is mounted at the opposite end of the base. The wedge blocks 8 and 9 are mounted between the second blade 4 and the third blade 5. A pivot end spacer block 10, at the pivot end of the base and a handle end spacer block 11, are mounted between the first blade 3 and the second blade 4.

The base 2 has a lower surface 18 and an upper surface 19, a high side 20 and a low side 21.

Figure 2:
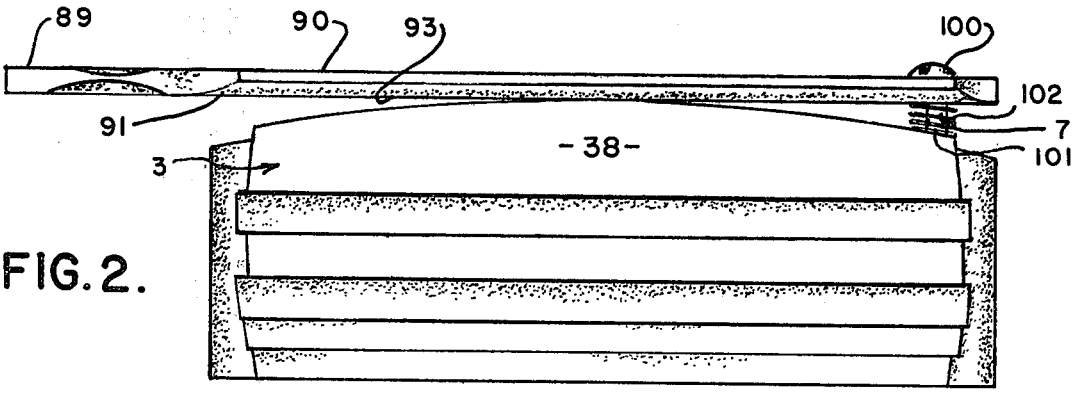
FIG. 2 is a view in side elevation in a direction from bottom to top of FIG. 1.
Figure 3:
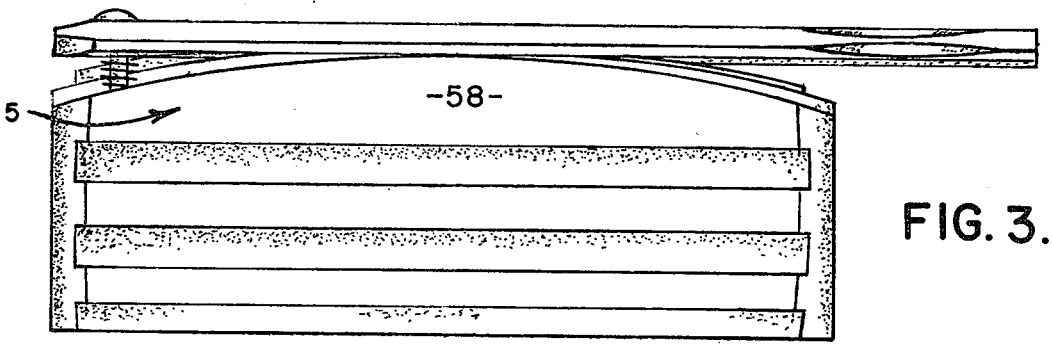
FIG. 3 is a view in side elevation in a direction from top to bottom of FIG. 1.

The first blade 3, mounted on the upper surface 19 inboard of but adjacent the high side 20 of the base, has an outer side 30 with an upper groove 31 and a lower groove 32 running the length of the blade parallel to the edge of the base, defined by a lower land 34, an intermediate land 33 and an upper blade section 38. The blade 3 has an uninterrupted planar side 35, a lower edge 36 and an upper edge 37. The upper edge 37 is thinner than the lower edge 36 and is arcuate in side elevation, as shown particularly in FIG. 2, and is beveled downwardly inboardly to provide a striker engaging sounding edge 39 along the upper blade section 38 of the grooved outer side 30. The blade 3 is set at an angle to the vertical, tending outboardly upwardly.

The second blade 4 has a grooved side 40 facing away from the blade 3, with an upper groove 41, a lower groove 42, a lower land 44, an intermediate land 43 and an upper blade section 48. It also has an uninterrupted planar side 45, a lower edge 46 and an upper edge 47. The second blade is set at an angle to the vertical in the same direction as the first blade 3. In this embodiment, the planar side 45 of the blade 4 tends from the vertical at the same angle as the planar side 35 of the blade 3. The upper edge 47 is thinner than the lower edge 46, and, in this embodiment thinner than the upper edge 37 of first blade 3. It is arcuate in side elevation, and is beveled downwardly inboardly, in the same direction as the upper edge 37 of first blade 3, to provide a striker engaging sounding edge 49 along the planar side 45.

The third blade 5 has an outboard side 50, with an upper groove 51, a lower groove 52, a lower land 54, an intermediate land 53 and an upper blade section 58. It also has an uninterrupted planar side 55, a lower edge 56 and an upper edge 57. The upper edge 57 is thinner than the lower edge 56, and, in this embodiment, is about the same thickness as the upper edge of the blade 4. It is arcuate in side elevation, and is beveled downwardly inboardly in the opposite direction from the bevels of the blades 3 and 4, to provide a striker engaging sounding edge 59. The blade 5 is also set at an angle from the vertical, but in the opposite direction from the blades 3 and 4.

Figure 4:
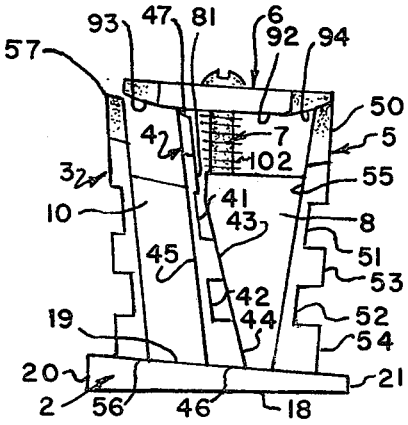
FIG. 4 is an end view from right to left of FIG. 1.
Figure 5:
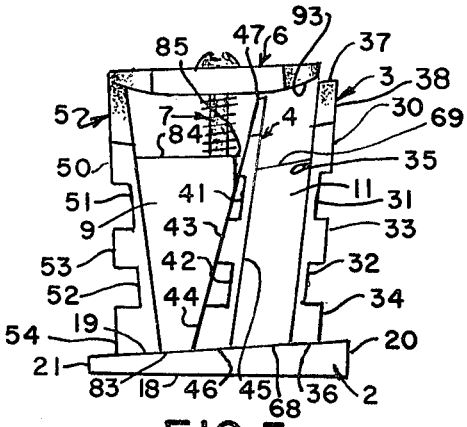
FIG. 5 is an end view from left to right of FIG. 1.
Figure 6:
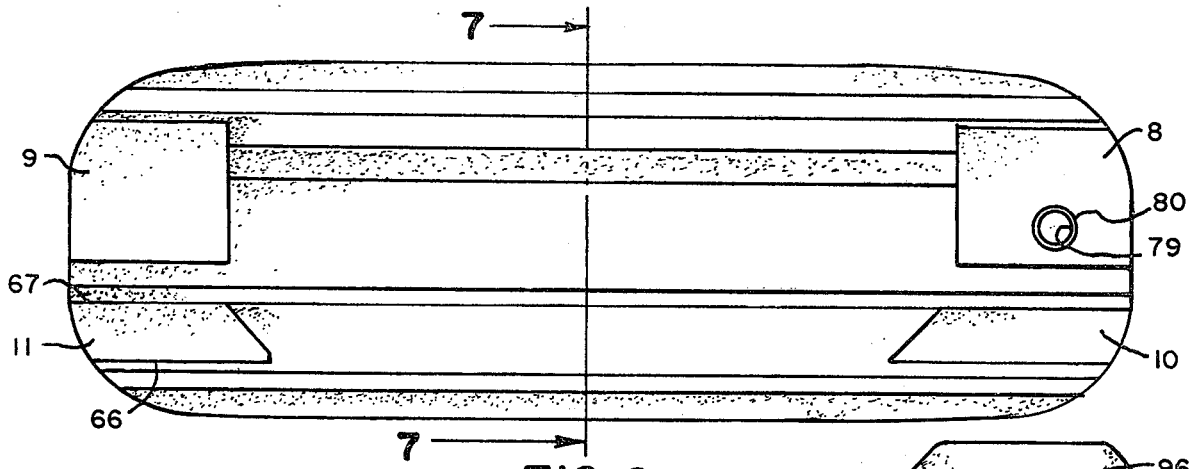
FIG. 6 is a top plan view, somewhat enlarged as compared with FIG. 1, of the call of FIG. 1, with the striker removed.

An outer, planar surface 60 of the spacer 10 and outer planar surface 66 of spacer 11 are taller than parallel planar inner surfaces 61 and 67 with respect to the upper blade sections 38 and 48 of the blades 3 and 4 respectively, as shown particularly in FIG. 4, and longer as well, as shown particularly in FIG. 6. This produces sloping top surfaces 63 and 69 respectively. Bottom surfaces 62 and 68 are, in this embodiment, sloped complementarily to the top surface 19 of the base, so as to permit their being glued tightly to the base. The surfaces 60 and 66 of the spacers 10 and 11 are connected securely flat against the side 35 of the blade 3, as by glue. The surfaces 61 and 67 are secured flat against the side 45 of the blade 4 in the same way. In this way, the free upper section 30 of the first blade 3 is no higher above the spacers 10 and 11, and is preferably somewhat less high, and has a shorter span lengthwise between the spacers 10 and 11 than the free upper section 48 of the second blade 4. This, coupled with the fact that the upper edge of the blade 3 is thicker than the upper edge of the blade 4, makes the blade 3 more rigid, and produces a higher pitched tone than blade 4. This is important in a turkey call, properly to imitate the bird's call, which has a falling inflection.

Figure 7:
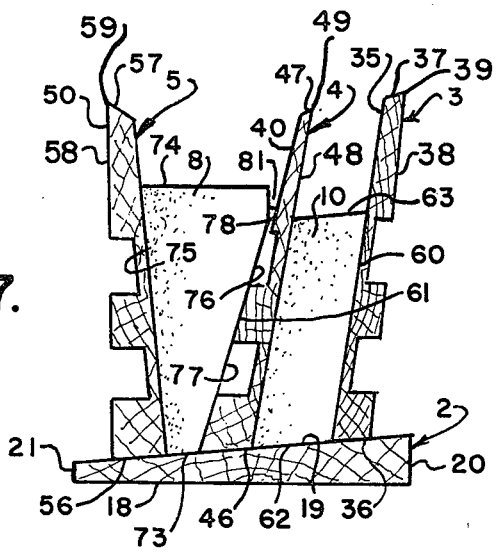
FIG. 7 is a sectional view taken along the line 7—7 of FIG. 6.
Figure 9:
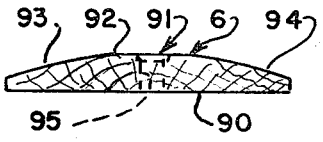
FIG. 9 is a sectional view taken along the line 9—9 of FIG. 8.
Figure 8:
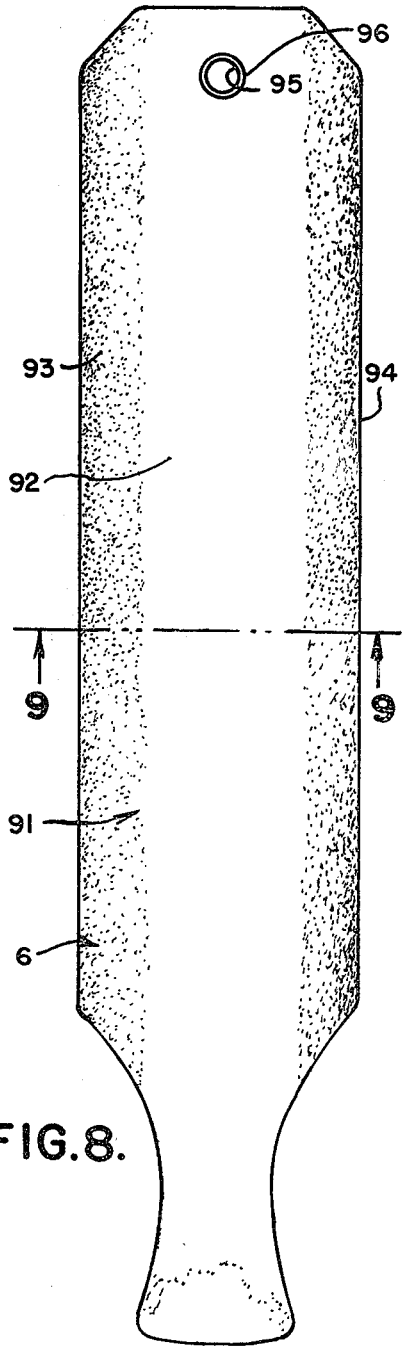
FIG. 8 is a bottom plan view, of the striker demounted from the device of FIG. 6.

The pivot block 8 has a bottom 73, sloped complementarily to the base, a top 74, an outside surface 75, and an inside surface 76. The inside surface 76 is divided into a slope section 77 and a vertical clearance section 78 extending downwardly from one edge of the top 74, all as shown in FIGS. 4 and 7. A pivot pin-receiving hole 79, shallowly counterbored to provide a spring seat 80, extends vertically through the top 74 and sufficiently far into the block 8 to permit the pin to be securely mounted. In the illustrative embodiment shown, the pin 7 is in the form of a screw with a smooth shank 101, and a slotted head 100.

The handle wedge block 9 has a bottom 83, a top 84, an outside surface corresponding to the surface 75 of the block 8, and an inside surface corresponding to the surface 76. As in the case of the block 8, the inside surface is divided into a slope section and a vertical clearance section.

The wedge locks 8 and 9 are, in this embodiment, mirror images of one another except for the pivot pin hole 79 in the block 8. Their bottom surfaces are glued to the upper surface 19 of the base and their outside surfaces are glued flat against the planar side 55 of the third blade 5. In this embodiment, the tops 74 and 84 are roughly parallel to the bottom surface 18 of the base, and the facing end walls of the blocks are squared off and parallel to one another. The slope sections of the inside surfaces are glued to the outer faces of the lands 43 and 44 of the second blade 4. The arris between the slope sections and the vertical clearance sections lies along the groove 41, and the vertical sections are spaced from the upper blade section 48, to leave a gap 81. This provision is important because it permits the blade 4 to vibrate freely.

The striker 6 has a flat upper surface 90 and a convex lower surface 91, which, in the embodiment shown, has a relatively flat center section 92 and arcuate sections 93 and 94, on the side of the blades 3 and 4 and on the side of the of the blade 5 respectively. The striker has a handle 89 at one end and, near its opposite end, a pivot pin passage 95, centered laterally, extending entirely through it. The passage 95 is shallowly counterbored in the lower surface 91 to provide a spring seat 96.

A helical compression spring 102 mounted on the shank of the pivot pin 7, seats at its lower end in the seat 80 and at its upper end in the seat 96, and is lightly compressed between them, biasing the striker 6 against the underside of the head 100. The passage 95 is sufficiently large with respect to the shank 101 to permit the striker to be rocked about its long axis, and the light bias of the spring permits the striker to be manipulated at will.

Merely by way of illustration and not of limitation, the call of this invention can be made as follows. All of the parts are made of red cedar. The base can be $2\frac{1}{4}''$ wide and 7" long, rounded at the corners. In this illustrative embodiment, the high side of the base is about 5/16" high, and the low side, about $\frac{1}{8}''$. The blades can be 7" long at the base. The first blade is set in $\frac{1}{4}''$ from the adjacent edge of the base, parallel to the long edge of the base. The bottom surface of the blade 3 is about $\frac{1}{4}''$ thick, the upper edge, measured across the bevel, about 3/32" thick. The planar side 35 slopes approximately 10° from the vertical; the outer side 30, approximately 5°. The bevel on the tops of the blades is approximately on an 11" radius, although the arc of the sides 93 and 94 of the striker is approximately on a 7" radius. The grooves 31 and 32 are about $\frac{3}{8}''$ high and of a depth to leave about 1/16" thickness between the bottom of the grooves and the planar side 35. The bottom land 34 is about $\frac{1}{4}''$ high; the intermediate land, $\frac{3}{8}''$ high. The center of the upper edge of the blade 3 lengthwise is its high point, and is $2\frac{1}{4}''$ above the top surface 19 of the base, 2 9/16" above the lower surface 18. The two ends of the upper edge of the blade are about $1\frac{7}{8}''$ above the surface 19, about 2 3/16" above the surface 18 to the sounding edge 39, and about 5/16" above the contiguous edge of the upper surface of the spacers 10 and 11 to the low side of the bevel.

The second blade 4 is about 5/16" thick at its lower edge 46, and about 1/16" wide across the bevel at its upper edge 47. The sounding edge 48 of the second blade is about 3/32" below the sounding edge of the first blade, and, at its ends, about $\frac{1}{4}''$ above the contiguous edge of the surfaces 61 and 67 of the spaces 10 and 11.

The planar surface 45 of the blade 4 is at the same angle from the vertical as the surface 35 of the blade 3. The side 40 tends about 15° from the vertical. The grooves and lands of the blade 4 have about the same dimensions as those of the blade 3. The upper blade section edge that defines the upper groove, is about $1\frac{5}{8}''$ above the lower surface 18 of the base.

The bottom and slope section of the wedge blocks 8 and 9 bear the same angular relation to one another as the upper surface of the base and the outer side 40 of the blade 4, so that the blocks fit tightly against those two surfaces. As has been pointed out heretofore, the arris between the slope section and the vertical clearance section of the wedge blocks lies below the upper groove-defining wall of the groove 41, and the slope of the outer side of the blade is such as to leave the gap 81. In the illustrative embodiment, the arris lies about 1 19/32" above the surface 18.

The third blade 5 is set in about 5/16" from the long edge of the base, parallel to that edge and therefore parallel to blades 3 and 4. The lower edge of the blade is about $\frac{3}{8}''$ wide, the upper edge, measured across the bevel, 5/32". The sounding edge is along the outboard surface 50, and at its center, about $2\frac{1}{2}''$ above the bottom surface 18. The planar side 55 slopes about 10° from the horizontal, the outboard side 50, about 5°. The grooves and lands can have the same dimensions as the grooves and lands of the first blade 3. The angular relation of the bottom and the outer side of the wedge blocks 8 and 9 is complementary to the angular relation of the upper surface 19 of the base and the surface 55 of the blade 5, so that the surfaces of the blocks and blade meet tightly along their glue joint.

The shank 101 can be about 3/16" in diameter, and the passage 95, about ¼". The center lines of the passage 95 and the hole 79 can be about ½" from the adjacent edge of the pivot block 8 and striker 6 respectively.

The third blade serves two functions, even though the essential part of the invention lies in the provision of two blades so arranged as to sound, when so desired, sequentially but at least momentarily concurrently when the striker is moved in one direction, from the first blade toward the third. The device can be used as a conventional call, by using only the first or the first and third blades. More importantly, the third blade serves to provide a sound box, amplifying the sound of the second blade 4.

Numerous variations in the construction of the call of this invention will occur to those skilled in the art in the light of the foregoing disclosure. Merely by way of illustration, another intermediate blade can be provided to permit the production of sounds of three different pitches momentarily concurrently, if the first blade and the two intermediate blades are angled and beveled in the same direction, or, alternatively, a dual call in either direction of movement of the striker, if the first and second blades are angled and beveled in one direction, and the third and fourth, in the opposite direction. The blades can be voiced to make them suitable for calling other game, as for example, geese, for which purpose it may be desirable to make the first blade thinner to produce a lower note followed by a note of higher pitch. The base can be made with upper and lower surfaces parallel, as distinguished from the wedge-shaped base described. In that event, the first and second blades, particularly, will have to be made of different heights from the upper surface of the base to produce the same relative heights from the lower surface of the base as in the embodiment described, but this is a simple matter and has been found to give excellent results. Instead of being angled from the vertical, the blades can be set vertically, the bevels of the top edges being adjusted to accomodate the different relative angle and remaining in the same direction, but the results are inferior to those obtained by the preferred embodiment of call of this invention. These are merely illustrative.

I claim:

1. In a game call of the striker and blade type including a base, the improvement comprising a a paddle-type striker attached to said base, said striker being pivotally mounted at one end and having a convex undersurface, a plurality of blades attached to said base, side by side but spaced from one another and extending generally in a common direction away from the pivot end of said striker, a first one of said blades being taller than a second, immediately adjacent blade, both of said blades being beveled in the same direction along their top edges, said edges being adapted to engage the convex undersurface of the striker sequentially as the striker is moved in one direction, but to remain at least momentarily in concurrent engagement therewith, said blades being constructed and arranged to produce sounds of different pitches.

2. The game call of claim 1 wherein the blades are of different thicknesses at their top edges and the striker is adapted to engage the thicker blade first.

3. The game call of claim 2 wherein the ratio of thicknesses of the top edges of the two blades is approximately three to two.

4. The game call of claim 1 wherein the said two immediately adjacent blades are separated by spacer blocks secured to facing planar surfaces of said blades and spaced lengthwise from one another along said base.

5. The game call of claim 4 wherein each of the spacer blocks has parallel broad sides secured to said planar surfaces, and a top surface that slopes downwardly toward the less tall of the two blades.

6. The game call of claim 4 wherein the spacer blocks are spaced lengthwise from one another, and have facing end surfaces that slope away from one another in the direction toward the less tall of the two blades, thereby providing a longer lengthwise span of the less tall blade.

7. The game call of claim 1 wherein said plurality includes three blades, the two immediately adjacent blades adapted to be sounded concurrently, and the third, spaced a greater distance at its top edge from the second than the top edge of the second is spaced from the first, said third blade being beveled in a direction opposite to the direction of the bevels of the said first and second blades, said second and third blades defining between them, with said base, an open-topped sound box.

8. The game call of claim 1 wherein the said immediately adjacent blades are sloped from the vertical in the same direction.

9. The game call of claim 8 wherein there are three blades, the third blade being spaced a greater distance from the second blade at their upper edges than the distance betweeen the upper edges of the second and first blades, said third blade being sloped from the vertical in the opposite direction from said first and second blades.

10. The game call of claim 9 wherein the second and third blades are separated by wedge blocks spaced from one another lengthwise of the base, the wedge blocks having faces sloped complementarily to the slopes of the facing surfaces of said second and third blades and secured thereto, a section of the face of said wedge blocks contiguous said second blade being spaced from said second blade, said spaced section extending toward the base a distance greater than the distance between the top edge of the second blade and the spacer block.

* * * * *